US005967260A

United States Patent [19]

Spak

[11] Patent Number: 5,967,260

[45] Date of Patent: Oct. 19, 1999

[54] FULL-LENGTH STEP LADDER WITH LARGE, FOLD-AWAY STEPS

[76] Inventor: George E. Spak, P.O. Box 7, Chenango Bridge, N.Y. 13745

[21] Appl. No.: 08/901,162

[22] Filed: Jul. 28, 1997

[51] Int. Cl.[6] ..... E06C 1/00

[52] U.S. Cl. ..... 182/165; 182/173; 182/228.3

[58] Field of Search ..... 182/22, 26, 151, 182/156, 164, 165, 166, 167, 168, 170, 171, 172, 173, 174, 175, 176, 177, 228.1, 228.3

[56] References Cited

U.S. PATENT DOCUMENTS

| | | | |
|---|---|---|---|
| 505,343 | 9/1893 | Austin | 182/156 |
| 1,735,003 | 11/1929 | Heidel | 182/228.1 X |
| 2,230,015 | 1/1941 | Rich | 182/176 X |
| 2,596,521 | 5/1952 | Bell . | |
| 3,268,031 | 8/1966 | Hampson | 182/228.1 X |
| 3,446,311 | 5/1969 | Alfie | 182/156 |
| 3,948,192 | 4/1976 | Yellin | 182/228.1 X |
| 4,024,929 | 5/1977 | Mintz | 182/228.1 X |
| 4,135,605 | 1/1979 | Matherne | 182/228.1 X |
| 4,457,398 | 7/1984 | Loix | 182/151 |
| 4,625,831 | 12/1986 | Rodgers, Jr. | 182/164 X |
| 4,757,876 | 7/1988 | Peacock . | |
| 5,722,507 | 3/1998 | Kain | 182/165 X |

*Primary Examiner*—Daniel P. Stodola
*Assistant Examiner*—Richard M. Smith
*Attorney, Agent, or Firm*—Salzman & Levy

[57] ABSTRACT

A fold-up step ladder having individually and independently fold-down steps that are deep recessed in their fold-down position, so that a person standing on the ladder can lean into and between the ladder frame defined by front and rear side rails and reach closer, with less obstruction and likelihood of injury, to an adjacent vertical wall or work object. Each step is supported upon the side rails of the ladder by an extension arm and a pair of right-angle flanges attached to respective side rails of the ladder frame. The flange bracing allows for support of over-sized steps, which in turn provides the standing person with a greater support and sure-footed feeling, as well as reduced fatigue upon the ladder.

9 Claims, 5 Drawing Sheets

FULL-LENGTH STEP LADDER WITH LARGE, FOLD-AWAY STEPS

FIELD OF THE INVENTION

This invention relates to ladders and, more particularly, to a full-length step ladder having steps that individually fold-away into the frame of the ladder for improving the worker's reach and access to objects extending above the ladder frame.

BACKGROUND OF THE INVENTION

The use of ladders, extensions, and scaffolding to reach objects extending above the height of an individual is as old as antiquity itself. The ladder arts are filled with many variations of extension assemblies. Many ladder assemblies illustrate fold-up ladders and ladders having fold-away steps.

In U.S. Pat. No. 4,757,876, issued to Peacock, on Jul. 19, 1988, for FOLDABLE TAIL GATE STEP ASSEMBLY, a small, fold-up ladder assembly is shown. The small ladder is intended to be used as a mounting platform at the back, or tail gate, of a truck or other vehicle. The ladder is foldable about its mid-section, and has fold-away steps. The steps individually fold away into the frame by means of a slot and pin arrangement. The pin is carried at the end portion of the step and rides within the slot of an extension member as the step is caused to be folded into the frame.

In U.S. Pat. No. 2,596,521, issued to Bell, on May 13, 1952 for STEPLADDER, a small stepladder is shown, wherein all the steps of the ladder are folded away simultaneously when the frame of the ladder is folded down. In its folded state, all of the steps project slightly above the frame surface.

A small step ladder, called Little Jumbo, featuring foldable steps and frame, is sold by Wing Enterprises, Inc. of Springville, Utah. This ladder has steps that simultaneously fold into the frame when the frame is collapsed, similar to the aforementioned ladder described by Bell.

The present invention features a full-length step ladder whose steps individually fold away into the frame. The invention differs from the previously described ladders in several important ways:

(a) the step ladder of this invention has steps that individually fold below the frame. This is a very useful feature when climbing the ladder, since a person can lean into the frame and obtain added reach to a wall or adjacent work surface without discomforting or injuring his or her shins;

(b) the sides of each step are rotationally anchored to the middle of the frame, so that the steps are indented to the frame in the fold-away position and do not project beyond the frame surface in the step operative position. This feature is very useful in providing a smooth, lean profile. The indenting of the steps also allows one to step or lean further into the ladder, thus providing safer footing and a longer reach towards an adjoining vertical work surface;

(c) each step is braced in its extended position by a right-angled flange. These flange braces provide greater internal support for the steps, so that the steps can be designed larger than normal steps of a step ladder. The larger steps provide better support and thus, less fatigue, than do conventional step ladder rungs; and they also provide a feeling of sure-footed stepping when one places a foot thereupon;

(d) unlike its predecessors, the ladder of this invention is full-sized. Prior art ladders of the folding step variety usually extend or rise only a few feet from the ground. This limitation is owing to the outwardly-projecting, fold-away steps which interfere with each other. By contrast, the ladder of the present invention has inwardly-projecting and recessed steps that allow the ladder to be built with full-length extension or height and no step interference for the worker's shins.

SUMMARY OF THE INVENTION

In accordance with the present invention, there is provided a full-length step ladder having individually folding steps. The steps are large in size, additionally supported by right angle flange bracing secured to the side rails of the frame. The large size of the steps provides for a surer and safer footing when climbing the ladder and for reduced fatigue when standing thereon. The right-angle flange braces are disposed beneath each step. Each step of the ladder has its outer edge flush with the side rails in the extended position, and has its step surface recessed below the side rails of the frame in a fold-down position. The recessed step surface allows a person supported upon the ladder to lean forward within the frame, achieving a greater reach towards an adjacent wall or an adjoining work surface.

It is an object of this invention to provide an improved step ladder.

It is another object of the invention to provide a step ladder than has larger-sized steps in order to afford the user greater support, a sure-footed feeling, and less fatigue.

It is a further object of this invention to provide a step ladder that allows each step to be folded away from the outer frame, independently, towards the interior of the ladder, thus affording a person supported thereon to lean between the side rails and achieve a greater reach extension towards a vertical work surface.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like elements and components will bear the same designations and numbering throughout the figures.

DESCRIPTION OF THE PREFERRED EMBODIMENT

Generally speaking, the invention features a fold-up step ladder having individually and independently fold-down steps. The steps are recessed in their fold-down position, so that a person standing on the ladder can lean into the ladder between the side rails and reach closer to an adjacent vertical wall or work object without injuring his or her shins. Each step is supported at the side rails of the ladder by an extension arm and a pair of right-angle flanges attached to respective side rails of the ladder frame. The flange bracing allows for support of over-sized steps which, in turn, provide the standing person with a greater support and sure-footed feeling upon the ladder.

Figure 1:
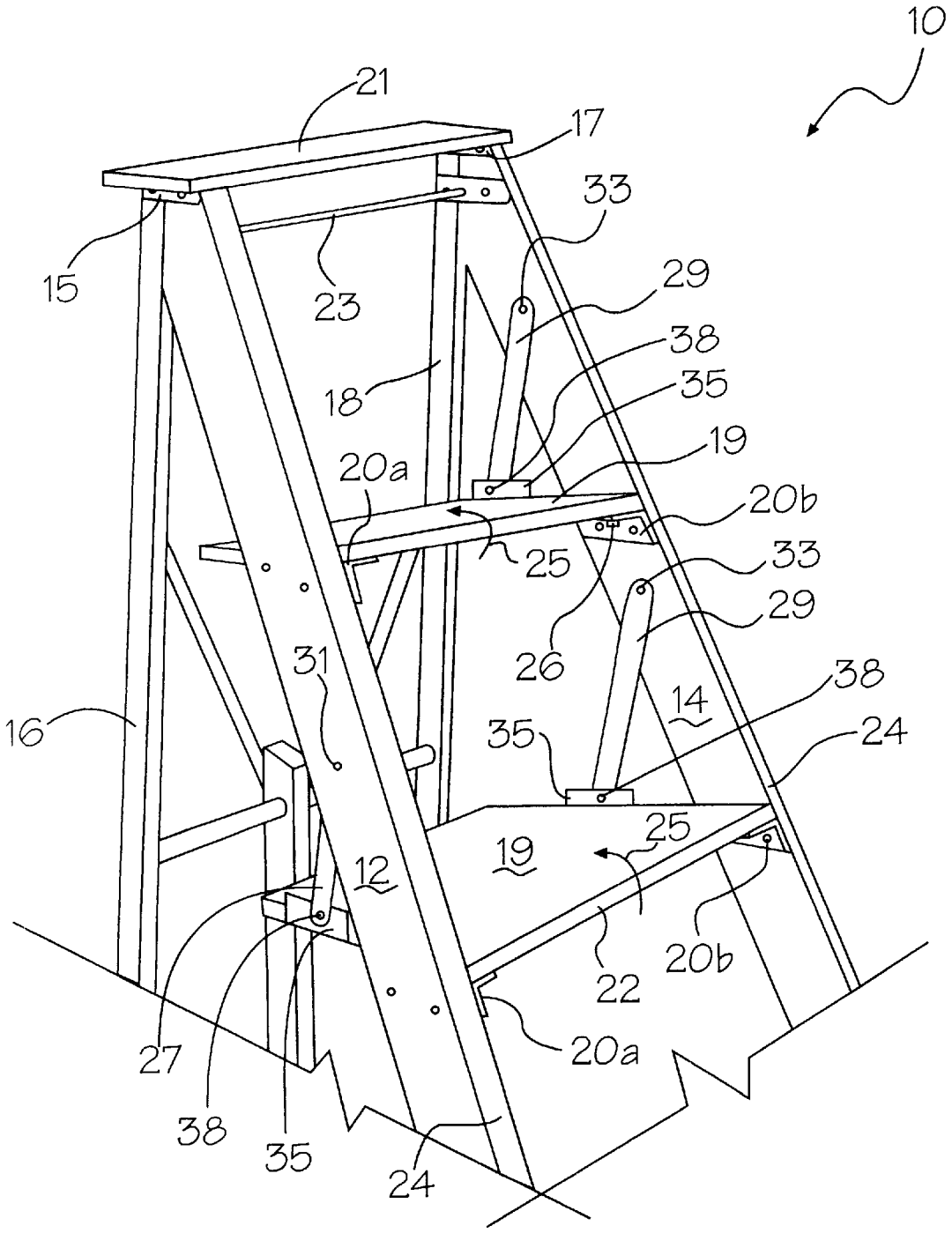
FIG. 1 illustrates a cut-away perspective view of the ladder of this invention, shown with the steps fully extended.
Figure 3:
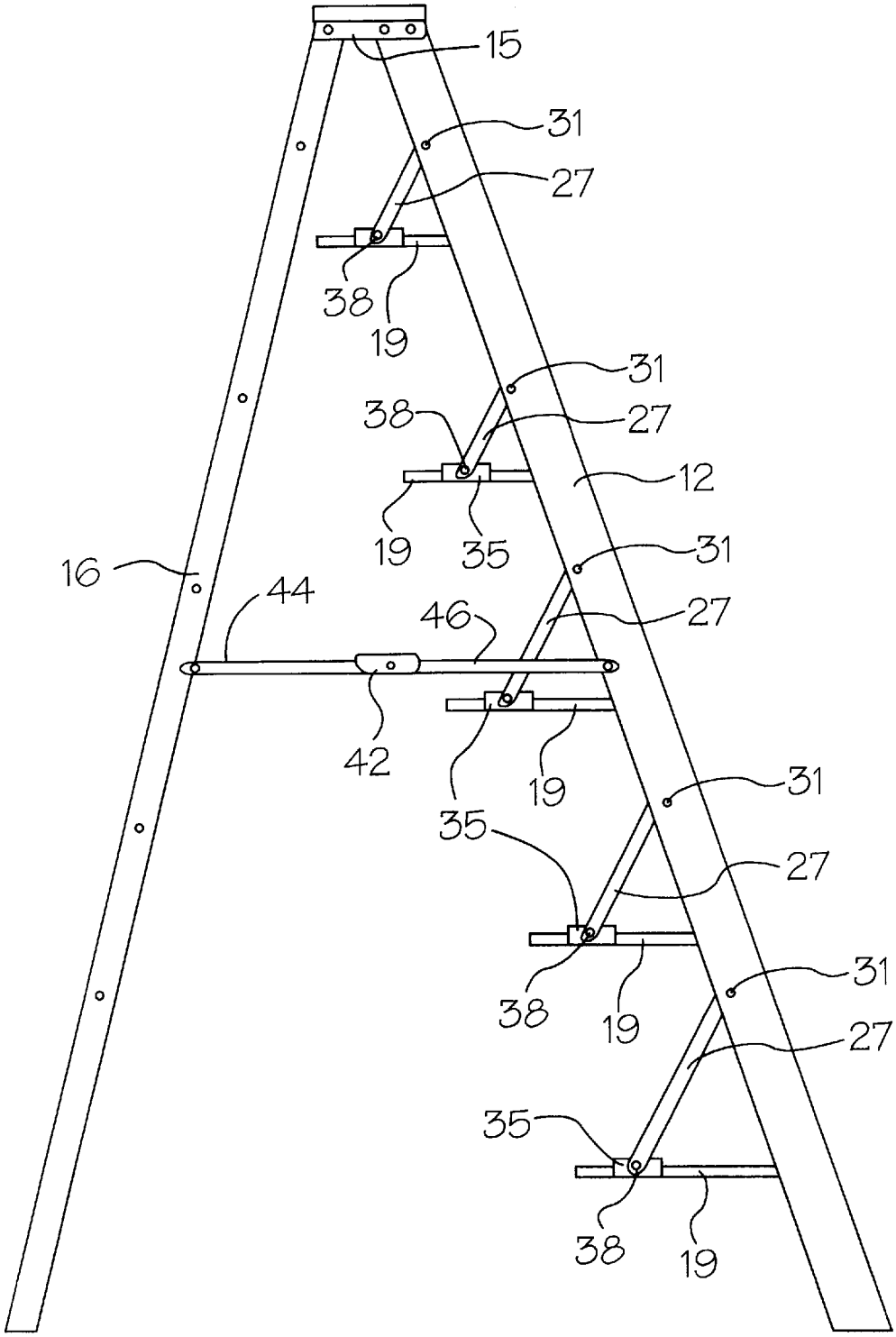
FIG. 3 shows a side view of the ladder depicted in FIG. 1.
Figure 5:
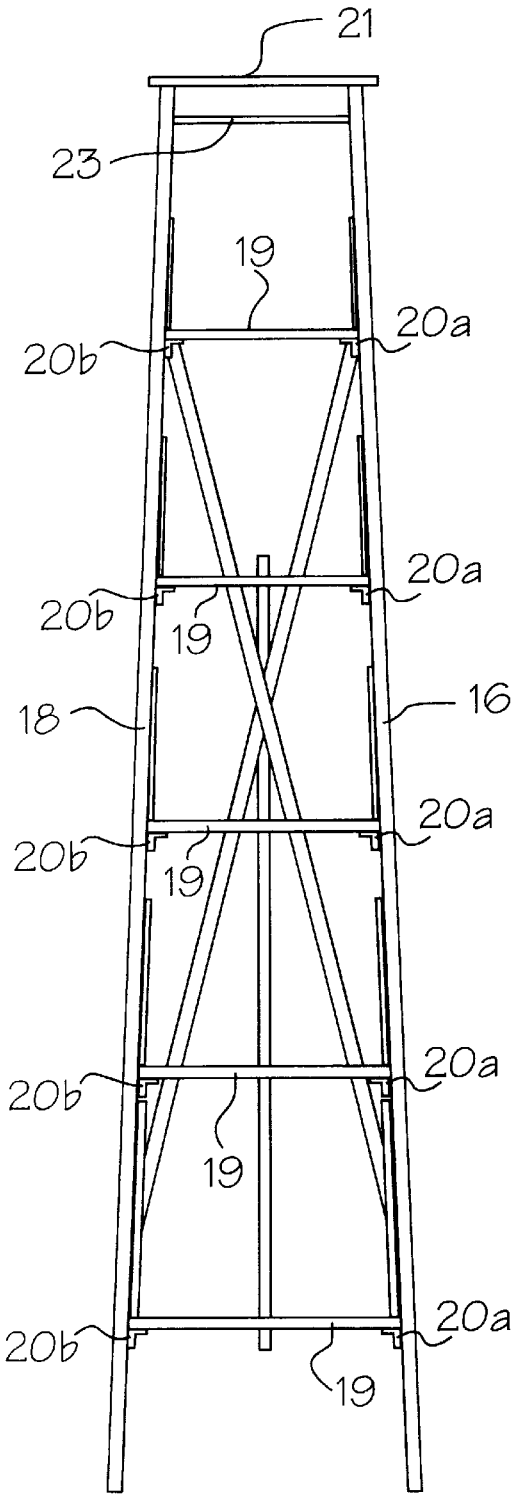
FIG. 5 shows a back view of the ladder depicted in FIG. 1.

Now referring to FIGS. 1, 3, and 5, the ladder 10 of this invention is illustrated. The ladder 10 is a full-sized step ladder. The frame of the ladder 10 includes a pair of front side rail supports 12 and 14 and a pair of respective back side rail supports 16 and 18. The side rails 12, 14, 16, and 18 are braced to each other about the top of the ladder 10 by a top step 21 and pair of metal straps 15 and 17. A metal rod 23 extends across the side rails in order to provide lateral bracing support.

Side rails 12 and 14 support a plurality of steps 19. In these views, the steps 19 are shown in their operative step position (i.e., ready to be stepped upon by a ladder climber).

Each step 19 is supported at the side rails 12 and 14 by a pair of right-angle flange braces 20*a* and 20*b*, respectively. Locking pins 26 secure flange braces 20*a* and 20*b* to the underside of step 19. The steps 19 have an outer lip surface 22 that is flush with the surfaces 24 of each respective side rail 12 and 14 in the operative step position. The surfaces 22 and 24 are flush to each other, in order to provide a smooth profile for the ladder 10.

Each step 19 is capable of folding down into the recesses of the ladder 10, as shown by arrows 25. The steps 19 are each folded down with a rotating and translating motion. For this purpose, each step 19 is rotatively and translatively supported by a pair of extension arms 27 and 29, respectively, that are rotatively affixed to their respective side rails 12 and 14 by pivot pins 31 and 33, respectively. The extension arms 27 and 29 are rotatively attached to a right angled, side flange support 35 that is disposed upon each step 19 on its respective right and left sides, as shown. The extension arms 27 and 29 are rotatively attached to right-angled, side flange supports 35 by pivot pins 38.

Figure 2:
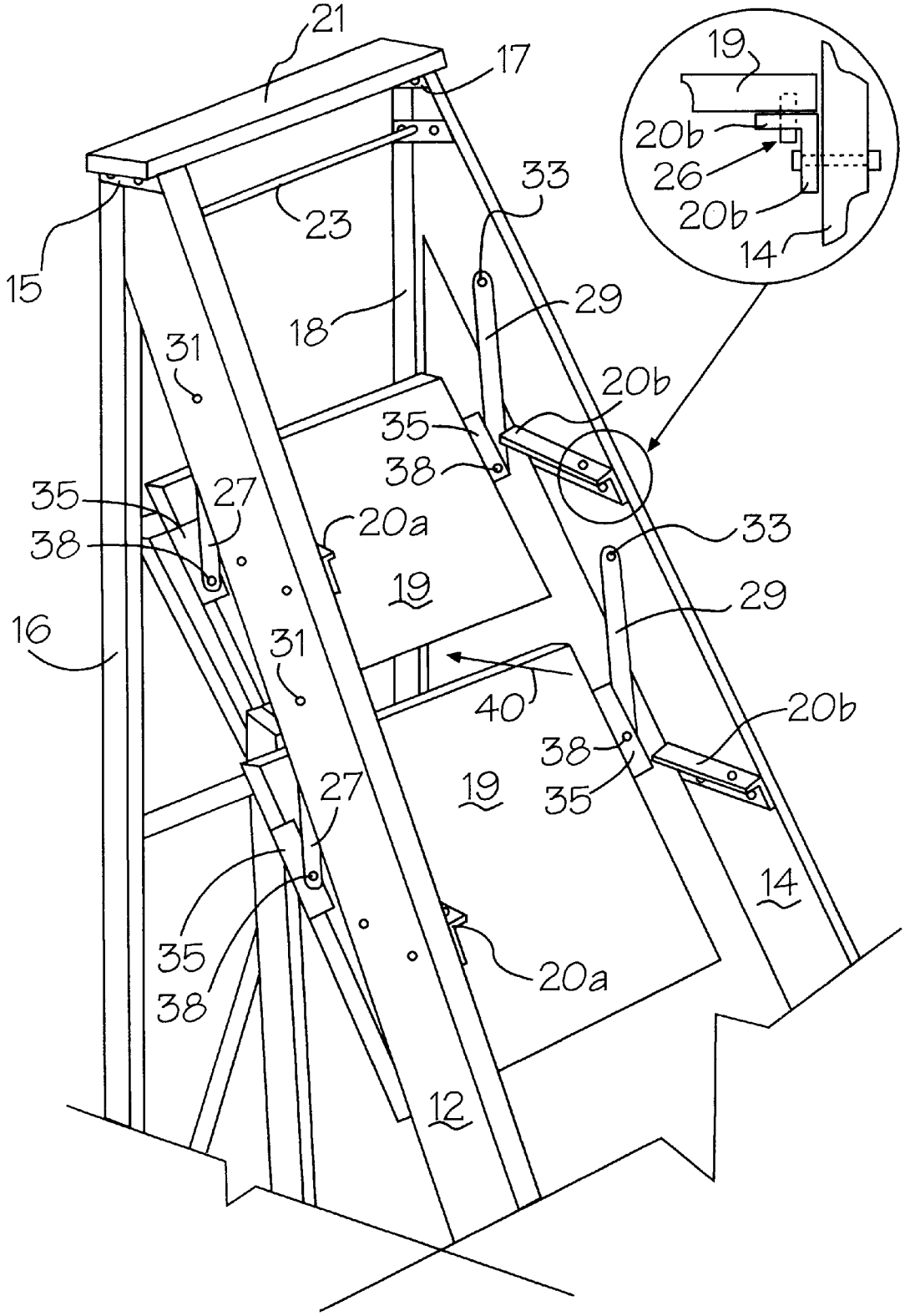
FIG. 2 depicts a cut-away perspective view of the ladder of this invention, shown with the steps in their fully recessed position.
Figure 4:
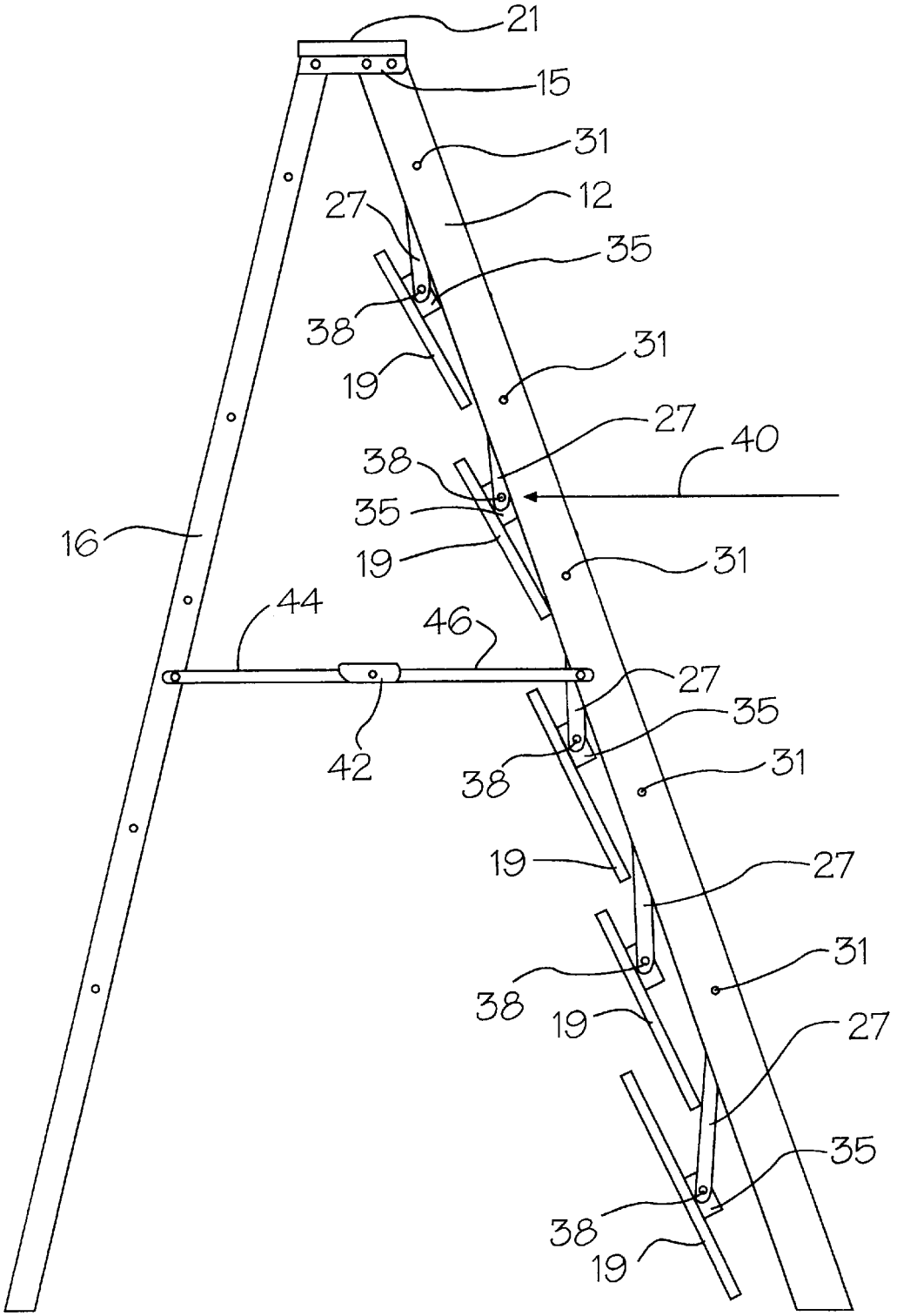
FIG. 4 shows a side view of the ladder depicted in FIG. 2.
Figure 6:
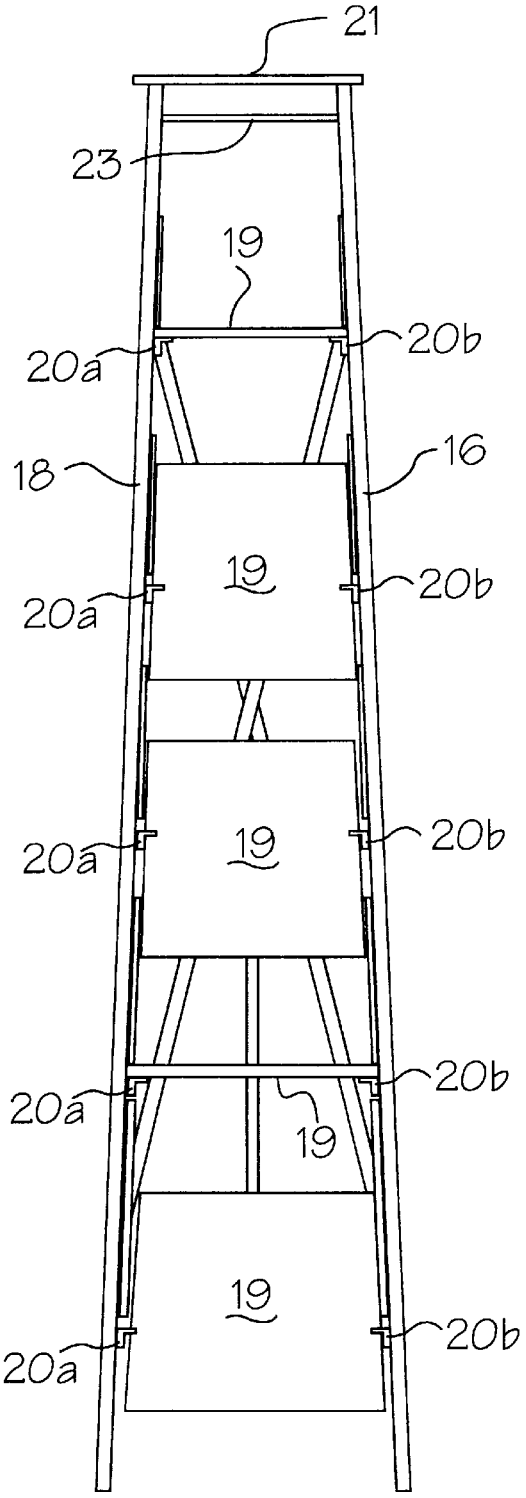
FIG. 6 shows a back view of the ladder depicted in FIG. 2.

Referring to FIGS. 2, 4, and 6, the ladder 10 of this invention is depicted with the steps 19 in their folded-down, recessed position. It will be observed that each step 19 is disposed far inside of the side rails 12 and 14 (see FIG. 4), so that someone standing upon an unfolded, lower step rung can lean forward into and between the side rails 12 and 14 (arrow 40). A space is created within the side rails 12 and 14 that defines a deep recess area in the frame of the ladder 10. The individual so leaning into the recess of the frame between side rails 12 and 14 is now capable of reaching a far wall or objects disposed adjacent to, or at the far side of, back rails 16 and 18. Since the steps 19 higher than that on which the worker has alighted do not extend outwardly, the worker is in no danger of having those upper steps press against or injure his or her shins or knees.

Flanges 20*a* and 20*b* lend a great measure of support to the steps 19, so that they can be made very large. The result is that when the upper steps 19 are in their folded-down, recessed position, one can stand on a lower, unfolded step 19 inside the frame side rails 12 and 14 to extend his or her reach, due to being able to stand at the rear of the large, weight-bearing surface of step 19.

The frame of the ladder 10 is foldable about pivot point 42, as shown in FIGS. 3 and 4. Two retractable arms 44 and 46 allow the side rails 12/16 and 14/18 to collapse inwardly toward each other, in a fashion well known in the step ladder art.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A step ladder having fold-down steps that are each translatively and rotationally movable between a step operative position and a folded-down, recessed position, said step ladder comprising:

a pair of front side rails having a number of spaced-apart flange braces for supporting a plurality of steps disposed between said front side rails;

a pair of back side rails operatively connected to the respective front side rails;

a plurality of planar, movable steps, each of said plurality of steps having an interior edge disposed proximate said pair of back rails, said interior edge being permanently, pivotally affixed to said pair of front rails; and an exterior edge of each of said plurality of steps being removably supported upon one of said spaced-apart flange braces, said steps being translatively and rotationally movable between a step operative position and a folded-down recess position, said folded-down recess position being located between said front side rails and back side rails, thus creating a recess area located between said respective pairs of front and back side rails, each of said steps occupying essentially the entire space between said pair of front rails and said pair of back rails when in said operative position; and means, operatively attached between said front side rails and said movable steps, for providing motion to rotatively and translatively move each respective step between said step operative position and said folded-down, recess position.

2. The step ladder having fold-down steps in accordance with claim 1, wherein said spaced-apart flange braces comprise right-angle flanges.

3. The step ladder having fold-down steps in accordance with claim 1, wherein each step has a lip surface that is substantially flush with said front side rails in said step operative position.

4. A step ladder having fold-down steps that are each translatively and rotatively movable between a step operative position and a folded-down, recessed position, a recessed area being created within said step ladder rails when said steps are in said folded-down, recessed position, said step ladder comprising:

a pair of front side rails having a number of spaced-apart braces for supporting a plurality of steps disposed between said front side rails;

a pair of back side rails operatively connected to the respective front side rails;

a plurality of individually and independently movable planar steps having exterior edges that are supported upon said spaced-apart braces on said front side rails, and interior edges permanently, pivotally affixed to said pair of front side rails, said movable steps being movable between a step operative position and a folded-down recess position, said folded-down recess position being located between said front side rails and said back side rails, thus creating a recess area between said respective pairs of front and back side rails; and means, operatively attached between said front side rails and each of said movable steps, for moving each respective step between said step operative position and said folded-down, recess position.

5. The step ladder having fold-down steps in accordance with claim 4, wherein said spaced-apart braces comprise angled flanges.

6. The step ladder having fold-down steps in accordance with claim 5, wherein each step has a lip surface that is substantially flush with said front side rails in said step operative position.

7. A step ladder having fold-down steps that are each movable between a step operative position and a folded-down, recessed position, a recessed area being created within said step ladder located between front and back side rails when said steps are in said folded-down, recessed position, said step ladder comprising:

a pair of front side rails having a number of spaced-apart braces for supporting a plurality of steps disposed between said front side rails;

a pair of back side rails operatively connected to the respective front side rails;

a plurality of planar, independently movable steps having exterior edges that are supported upon said spaced-apart braces on said front side rails, and interior edges permanently, pivotally affixed to said front side rails, said movable steps being movable between a step operative position and a folded-down recess position, said folded down recess position being located between said front side rails and said back side rails away from a climbing area, thus creating a recess area adjacent said climbing area, each step being sized to occupy essentially the entire area between said front rails and said back rails when said steps are in said step operative position so that one can stand upon each step and be disposed within said recess area; and means operatively attached between said front side rails and each of said movable steps for moving each respective step between said step operative position and said folded-down, recess position.

8. The step ladder having fold-down steps in accordance with claim 7, wherein said spaced-apart braces comprise angled flanges.

9. The step ladder having fold-down steps in accordance with claim 7, wherein each step has a lip surface that is substantially flush with said front side rails in said step operative position.

* * * * *